US009933124B2

(12) United States Patent
Ticktin et al.

(10) Patent No.: US 9,933,124 B2
(45) Date of Patent: Apr. 3, 2018

(54) CEILING MOUNTED LIGHTING ASSEMBLY WITH SELF-CONTAINED JUNCTION BOX APPARATUS AND METHOD

(71) Applicant: CooLEDlite, Inc., Deerfield Beach, FL (US)

(72) Inventors: Peter Ticktin, Deerfield Beach, FL (US); Thomas Cartwright, Stuart, FL (US)

(73) Assignee: COOLEDLITE, INC., Deerfield Beach, FL (US)

( * ) Notice: Subject to any disclaimer, the term of this patent is extended or adjusted under 35 U.S.C. 154(b) by 111 days.

(21) Appl. No.: 15/186,071

(22) Filed: Jun. 17, 2016

(65) Prior Publication Data

US 2017/0363263 A1 Dec. 21, 2017

(51) Int. Cl.

| | |
|---|---|
| ***F21S 8/00*** | (2006.01) |
| ***F21S 8/04*** | (2006.01) |
| ***F21V 29/15*** | (2015.01) |
| ***F21V 21/03*** | (2006.01) |
| ***F21K 9/238*** | (2016.01) |
| *F21Y 115/10* | (2016.01) |

(52) U.S. Cl.
CPC ..... *F21S 8/04* (2013.01); *F21K 9/238* (2016.08); *F21V 21/03* (2013.01); *F21V 29/15* (2015.01); *F21Y 2115/10* (2016.08)

(58) Field of Classification Search
CPC .. F21S 8/04; F21S 8/046; F21K 9/238; F21K 9/27; F21K 9/272; F21K 9/275; F21V 29/2212; F21V 29/20; F21V 29/30; F21V 21/03; F21V 21/04; F21V 21/041; F21Y 2115/10
See application file for complete search history.

(56) References Cited

U.S. PATENT DOCUMENTS

| | | | | |
|---|---|---|---|---|
| 5,057,980 | A | 10/1991 | Russell | |
| 6,369,326 | B1 * | 4/2002 | Rippel | F21V 21/04 174/50 |
| 6,929,389 | B1 * | 8/2005 | Rhee | F21S 8/04 362/147 |
| 7,438,433 | B1 * | 10/2008 | Steadman | F21S 8/02 362/147 |
| 7,682,051 | B2 | 3/2010 | Xiao et al. | |
| 8,567,999 | B2 * | 10/2013 | Paik | F21S 48/328 362/257 |
| 8,944,637 | B2 | 2/2015 | Spiro | |
| 9,039,253 | B2 * | 5/2015 | Jin | F21S 8/04 362/154 |

* cited by examiner

*Primary Examiner* — Ali Alavi
(74) *Attorney, Agent, or Firm* — The Concept Law Group, PA; Scott D. Smiley

(57) ABSTRACT

A ceiling mounted lighting assembly is disclosed having a below-the-ceiling junction box with a ceiling-mounting surface and a light socket disposed at least partially within the below-the-ceiling junction box; a terminal block disposed at least partially within the below-the-ceiling junction box and electrically couplable to the light socket; and at least one fastener coupled to the ceiling-mounting surface and extending in a direction away from the ceiling-mounting surface.

20 Claims, 16 Drawing Sheets

CEILING MOUNTED LIGHTING ASSEMBLY WITH SELF-CONTAINED JUNCTION BOX APPARATUS AND METHOD

FIELD OF THE INVENTION

The present invention relates generally to light fixtures, and, more particularly, relates to a method and apparatus with a ceiling mounted lighting assembly having a self-contained junction box.

BACKGROUND OF THE INVENTION

Existing light-emitting diode (LED) lights have become increasingly popular because they are known to be generally energy efficient, as compared to incandescent lights, and provide a high quality brightness and color. Further, LED lights are known to have a generally higher life expectancy as compared to incandescent lights. As an example, many newer LED lights have a life span of about 30,000 hours, compared to an estimated 7,500 hours for a compact fluorescent bulb and 1,000 hours for an incandescent bulb.

However, the environment in which the LEDs operate is important to their longevity. LEDs are semiconductor devices that, like most semiconductors, will degrade from excessive heat. LEDs and their drivers (i.e., electrical components) will degrade and operate less efficiently if exposed to heat gain and/or excessive temperature fluctuations. LEDs have been known to flicker, dim, or not work at all in extreme cold and hot temperatures. In fact, exposure to too much heat has been considered one of the primary reasons for the failure of many LED lights. Accordingly, heat gain and excessive temperature fluctuations will decrease the life expectancy of the LED and tend to negate at least some of the positive benefits associated with LEDs.

One existing solution for the thermal management of LEDs is to include metal heatsinks disposed to draw heat away from the LED chip. Another existing solution is to incorporate heat pipes and vapor chambers as a passive heat-transfer pathway to allow heated air emitted by the LED to be drawn away from the LED light. Yet another existing solution is to utilize a thermally conductive adhesive to bond the LED, its board, and the heat sinks.

Unfortunately, these existing solutions have their drawbacks. In particular, these solutions are limited to traditional heat-transfer methods of conduction, convention, and radiation in order to mitigate heat generated by the LED itself. These existing solutions do not address external thermal sources that also negatively affect the longevity of the LED. In addition, these existing solutions do not address the problem associated with temperature fluctuations between extreme high temperatures, as well as, extreme low temperatures.

The inventors of the present invention have discovered that ceiling mounted LED lights are particularly susceptible to such external thermal source problems. Specifically, the temperature in the attic area and other above-the-ceiling areas can be extremely high, particularly during the summer season and in year-round warm temperature regions. Likewise, during cold seasons, temperatures in the attic area may become excessively low. Ceiling mounted lights are typically installed with a conventional above-the-ceiling junction box that is open to the attic area or other areas disposed above a finished ceiling to mount a light to and provide an electrical supply source to power the light. Conventional above-the-ceiling junction boxes are typically poorly insulated electrical boxes that are directly exposed to the superheated attic air and readily transfer the superheated attic air directly to the LED light and its associated electronic components. Therefore, these existing conventional above-the-ceiling junction boxes contribute to the deterioration of the LED lights and shorten the life expectancy of LED lights as a result of the exposure to heat gain and temperature fluctuations present in many attic and other above-the-ceiling areas.

Another drawback with conventional above-the-ceiling junction boxes is the installation processes and apparatuses. More particularly, installing the above-the-ceiling junction box typically requires a complex process that involves creating large openings in the ceiling, utilizing large support brackets, and employing complicated electrical wiring, which is often beyond the technical skill of many users. Thus, a user may be required to either hire a costly electrician to perform the installation, or attempt the installation himself. Still yet, the overall process for installing ceiling lights on a finished ceiling, without a pre-existing installation, can be cumbersome for the user, overly complicated, and inefficient.

Moreover, although some conventional junction boxes may be attached to a ceiling, that application causes the unsightly appearance of the junction box, and for LED or other light applications, it fails to provide a finished look to the ceiling.

Therefore, a need exists to overcome the problems with the prior art as discussed above.

SUMMARY OF THE INVENTION

The invention provides a ceiling mounted lighting assembly with self-contained junction box apparatus and method that overcomes the hereinafore-mentioned disadvantages of the heretofore-known devices and methods of this general type.

With the foregoing and other objects in view, there is provided, in accordance with the invention, a method of installing a ceiling mounted lighting assembly, the method including steps of providing a ceiling mounted lighting assembly within a below-the-ceiling area, the ceiling mounted lighting assembly having a below-the-ceiling junction box with a first end including a ceiling-mounting surface and a light socket disposed at least partially within the below-the-ceiling junction box; a terminal disposed at least partially within the below-the-ceiling junction box and electrically couplable to the light socket; and at least one ceiling fastener coupled to the ceiling-mounting surface and extending in a direction away from the ceiling-mounting surface. At least one electrical conductor may be inserted from an above-the-ceiling area directly through an aperture defined by a ceiling to the below-the-ceiling area without passing the electrical conductor through an above-the-ceiling junction box. Further, the at least one electrical conductor may be coupled to the terminal disposed at least partially within the below-the-ceiling junction box; and the ceiling fastener may be inserted through at least a portion of the ceiling so as to secure the below-the-ceiling junction box against a below-the-ceiling-facing surface of the ceiling.

In accordance with another feature, an embodiment of the present invention includes providing the first end of the below-the-ceiling junction box as a thermal barrier between the above-the-ceiling area and the below-the-ceiling area.

In accordance with yet another feature, an embodiment of the present invention includes providing the ceiling-mounting surface of the first end with a thermally insulating material.

In accordance with another feature, an embodiment of the present invention includes coupling a light source to the light socket at least partially disposed within the below-the-ceiling junction box.

In accordance with yet another feature, an embodiment of the present invention includes locating a mounting portion of the ceiling, the mounting portion of the ceiling having an above-the-ceiling-facing surface opposite the below-the-ceiling-facing surface; and creating the aperture within the mounting portion of the ceiling as a through-hole extending through the above-the-ceiling-facing surface and the below-the-ceiling-facing surface.

In accordance with another feature, an embodiment of the present invention includes providing the ceiling mounted lighting assembly with the light socket and the terminal entirely disposed within the below-the-ceiling junction box.

In accordance with another feature, an embodiment of the present invention includes providing the below-the-ceiling junction box with a trim at least one of fixedly connected to the below-the-ceiling junction box and removeably couplable to the below-the-ceiling junction box, the trim disposed to conceal the below-the-ceiling junction box from an upward-looking view of a viewer during an installed configuration of the ceiling mounted lighting assembly.

In accordance with yet another feature, an embodiment of the present invention includes providing the below-the-ceiling junction box with a second end opposite the first end; at least one junction box sidewall interposed between the first end and the second end, the first and second ends and the at least one junction box sidewall defining a below-the-ceiling junction box cavity within which the light socket and the terminal are at least partially disposed; and a trim disposed to conceal the below-the-ceiling junction box from an upward-looking view of a viewer during an installed configuration of the ceiling mounted lighting assembly.

In accordance with a further feature, an embodiment of the present invention includes providing the trim continuously about a periphery of the at least one junction box sidewall.

In accordance with another feature, an embodiment of the present invention includes providing the trim coupled to the below-the-ceiling junction box so as to extend from the second end of the below-the-ceiling junction box outwardly and upwardly beyond a plane defined by the at least one junction box sidewall.

In accordance with another feature, an embodiment of the present invention includes a ceiling mounted lighting assembly with a self-contained junction box including a below-the-ceiling junction box having a first end with a ceiling-mounting surface and a light socket disposed at least partially within the below-the-ceiling junction box; and a terminal disposed at least partially within the below-the-ceiling junction box and electrically couplable to the light socket.

In accordance with a further feature of the present invention, the first end of the below-the-ceiling junction box is a thermal barrier between an above-the-ceiling area and a below-the-ceiling area.

In accordance with another feature of the present invention, the ceiling-mounting surface of the first end is of a thermally insulating material.

In accordance with yet another feature of the present invention, at least one ceiling fastener coupled to the ceiling-mounting surface and extending in a direction away from the ceiling-mounting surface.

In accordance with another feature of the present invention, the ceiling fastener includes a ceiling-penetrating end opposite a junction-box-coupling end, the ceiling-penetrating end disposed to penetrate a ceiling from a below-the-ceiling area so as to secure the ceiling mounted lighting assembly to the ceiling in an installed configuration.

In accordance with a further feature of the present invention, the light socket and the terminal are entirely disposed within the below-the-ceiling junction box.

In accordance with another feature, an embodiment of the present invention also includes a trim at least one of fixedly connected to the below-the-ceiling junction box and removeably couplable to the below-the-ceiling junction box and disposed to conceal the below-the-ceiling junction box from an upward-looking view of a viewer during an installed configuration of the ceiling mounted lighting assembly.

In accordance with yet another feature of the present invention, the below-the-ceiling junction box further includes a second end opposite the first end; at least one junction box sidewall interposed between the first end and the second end, the first and second ends and the junction box sidewall defining a below-the-ceiling junction box cavity within which the light socket and the terminal are at least partially disposed; and a trim disposed to conceal the below-the-ceiling junction box from an upward-looking view of a viewer during an installed configuration of the ceiling mounted lighting assembly.

In accordance with a further feature of the present invention, the trim is disposed continuously about a periphery of the junction box sidewall.

In accordance with yet another feature of the present invention, the trim is coupled to the below-the-ceiling junction box so as to extend from the second end of the below-the-ceiling junction box outwardly and upwardly beyond a plane defined by the at least one junction box sidewall.

Although the invention is illustrated and described herein as embodied in a ceiling mounted lighting assembly with self-contained junction box apparatus and method, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the ceiling fastener.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
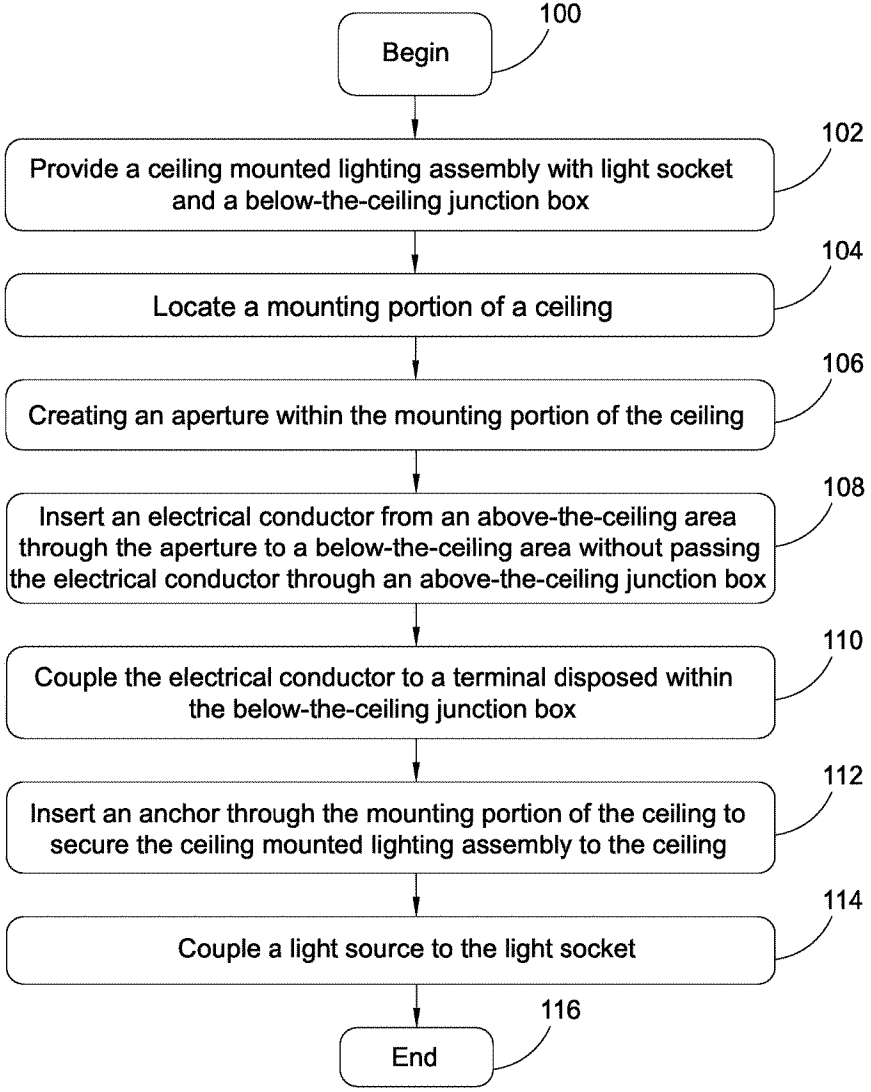
FIG. 1 is a block diagram of a flow chart representing an exemplary method of installing a ceiling mounted lighting assembly in accordance with an embodiment of the present invention.
Figure 2:
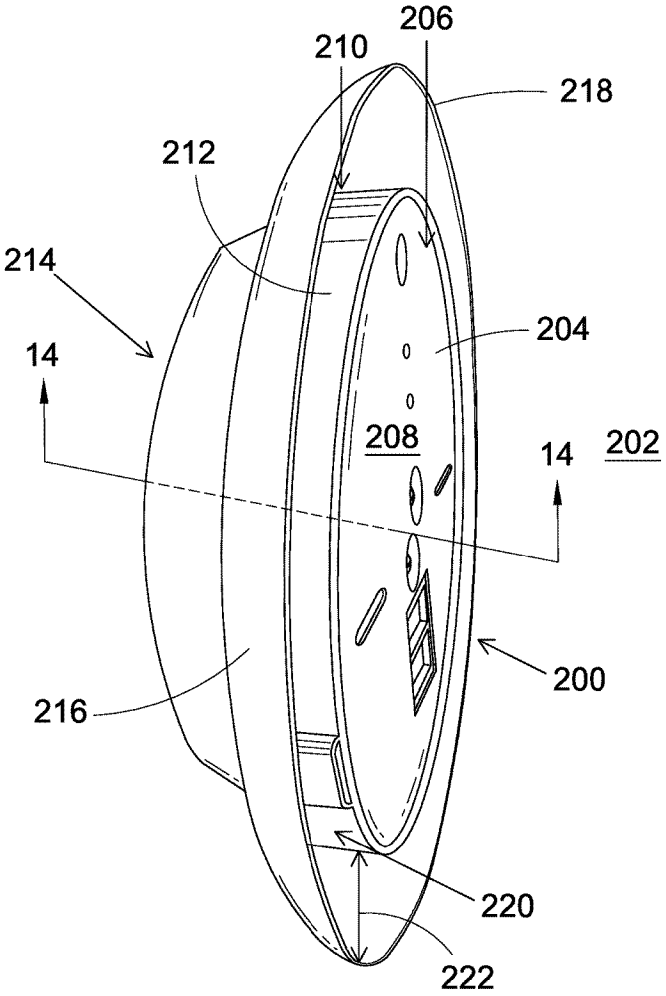
FIG. 2 is a perspective view of an exemplary ceiling mounted lighting assembly with a below-the-ceiling junction box in accordance with the present invention.
Figure 3:
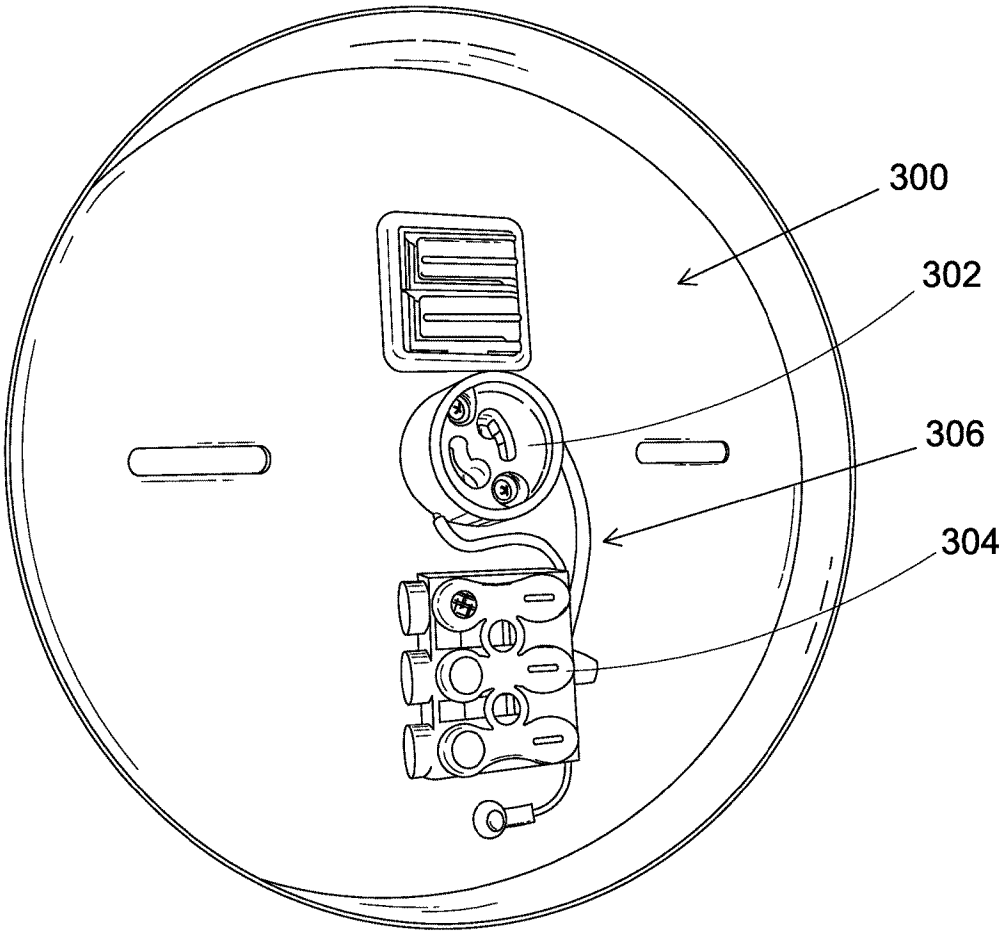
FIG. 3 is a fragmentary, downward-looking view of a top portion of the below-the-ceiling junction box of the ceiling mounted lighting assembly of FIG. 2, illustrating an interior of the top portion, in accordance with an embodiment of the present invention.
Figure 4:
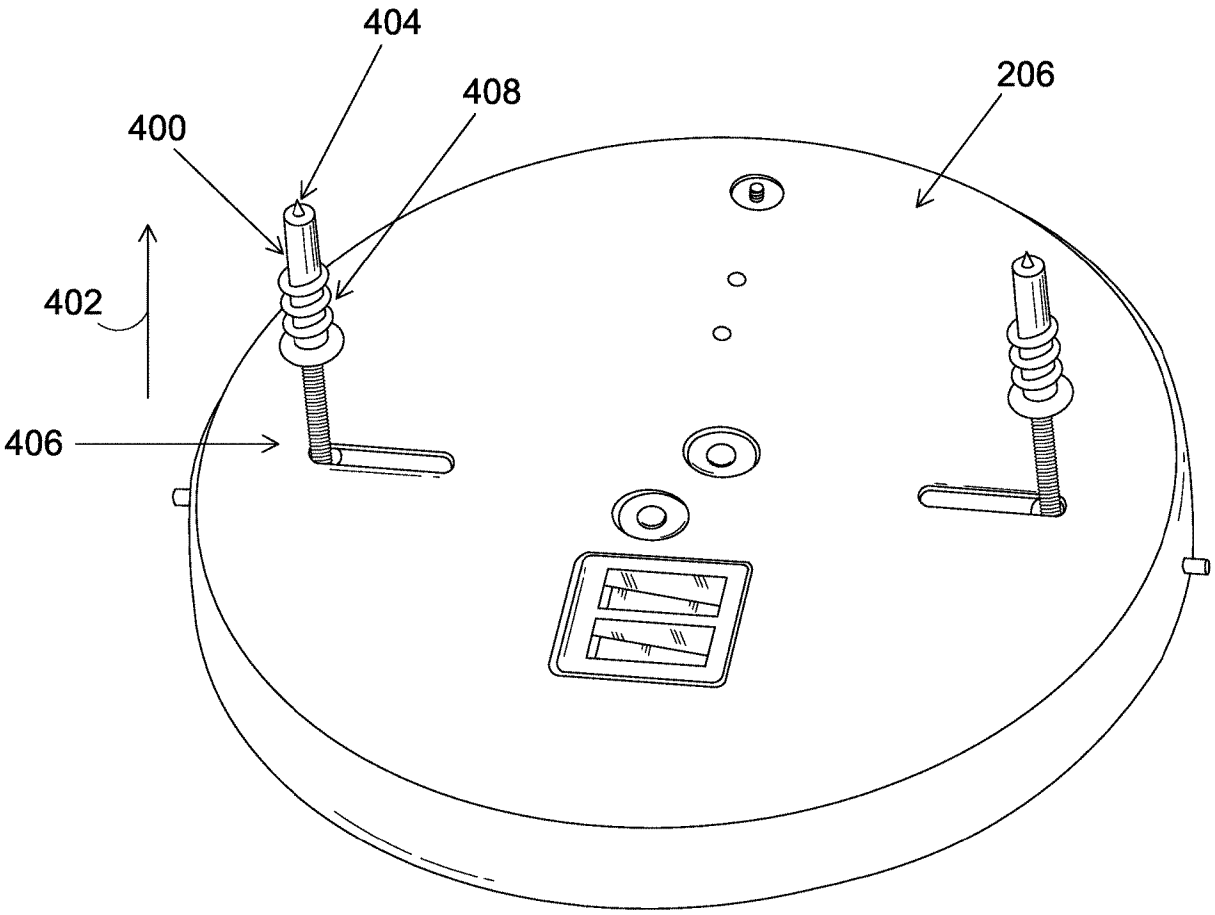
FIG. 4 is a fragmentary, downward-looking view of the top portion of the below-the-ceiling junction box of the ceiling mounted lighting assembly of FIG. 2, illustrating an exterior of the top portion shown with a pair of ceiling fasteners coupled thereto, in accordance with an embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient apparatus and method for installing a ceiling mounted lighting assembly with a self-contained junction box disposed within a below-the-ceiling area. Embodiments of the invention provide a below-the-ceiling junction box having a ceiling-mounting surface and a light socket disposed at least partially within the below-the-ceiling junction box. In addition, embodiments of the invention provide for the ceiling-mounting surface to be of a thermally non-conductive material and operable as a thermal barrier between the above-the-ceiling area and the below-the-ceiling area. Further embodiments of the invention include installing the ceiling mounted lighting assembly with the self-contained junction box to a finished ceiling without any pre-existing ceiling installations and without utilizing a conventional above-the-ceiling junction box so as to minimize any openings into the above-the-ceiling area. Other embodiments of the present invention include a decorative trim disposed about the below-the-ceiling junction box so as to conceal the below-the-ceiling junction box from an upward-looking view of a viewer during an installed configuration of the light assembly. Embodiments of the present invention mitigate the exposure of ceiling mounted LED lights to the superheated attic air and excessive temperature fluctuations associated with attic temperatures, thereby prolonging the life span of ceiling mounted LED lights. In addition, embodiments of the present invention provide for user-friendly and convenient installation of ceiling mounted lights that reduce the complexity of existing ceiling mounted light installation processes and apparatuses and that minimize thermally coupling of the LED lights to the attic area.

Referring now to FIG. 1, one embodiment of the present invention is shown in a block diagram view. FIG. 1 shows several advantageous features of the present invention, but, as will be described below, the invention can be provided in several shapes, sizes, combinations of features and components, and varying numbers and functions of the components. The first example of a method of installing a ceiling mounted lighting assembly is shown in FIG. 1. Although FIG. 1 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 1 for the sake of brevity. FIGS. 2-16 will also be described in conjunction with the process flow chart of FIG. 1.

The process may begin with step 100 and immediately proceed to step 102, where a ceiling mounted lighting assembly 200 is provided within a below-the-celling area 202. The term "below-the-ceiling area" is intended to indicate an area, typically within a room or other compartment, disposed directly beneath a ceiling. It should also be understood that the ceiling mounted lighting assembly 200 is preferably configured as an LED ceiling mounted lighting assembly; however, some embodiments may be useful for other types of non-LED lights.

In one embodiment, the ceiling mounted lighting assembly 200 includes a below-the-ceiling junction box 204. As is known in the art, junction boxes are devices that encompass wiring junctions or electrical intersections to allow wiring in a residential or other building to interface with a main power supply. Unlike traditional junction boxes that are typically recessed within a wall or ceiling panel, the below-the-ceiling junction box 204 is disposed external to a ceiling 1000 in the below-the-ceiling area 202.

The below-the-ceiling junction box 204 may be made of various materials such as, for example, metal or hard plastic. In a preferred embodiment, the below-the-ceiling junction box 204 includes a first end 206 with a ceiling-mounting surface 208 that is of a thermally insulating material. Stated another way, the first end 206 of the below-the-ceiling junction box 204 may be operable as a thermal barrier between the below-the-ceiling area 202 and an above-the-ceiling area 1002. The thermally insulating material may be of a thermally insulating metallic material, such as, a thermally insulating foil material. In another embodiment, the thermally insulating material may be fiberglass. In yet another embodiment, the thermally insulating material may be a thermally insulating polymer material. The thermally insulating material may be a composite material. In another embodiment, the thermally insulating material may be a thermally insulating coating applied on a non-thermally insulating material. In yet another embodiment, the thermally insulating material may be a thermally insulating coating applied on a thermally insulating material to further enhance thermal insulation. In one embodiment, the thermally insulating material may have an R-value of at least 2.0. An R-value is a measure of thermal resistance used in the building and construction industry. In alternative embodiments, the thermally insulating material may have an R-value outside of this range.

In some embodiments, the below-the-ceiling junction box 204 may be of a non-thermally insulating material. In some of these embodiments, the structure of the assembly 200 and/or the inventive method of installing, as explained in more detail herein below, may be sufficient to reduce degradation caused by heat gain and excessive temperature fluctuations associated with traditional above-the-ceiling junction boxes and traditional methods of installing ceiling lights.

In one embodiment, the ceiling-mounting surface 208 of the first end 206 may be generally planar so as to mate in a generally parallel relationship with the ceiling 1000. In another embodiment, the first end 206 may be formed as a plate. In other embodiments, the ceiling-mounting surface 208 may be provided in other shapes, sizes, and configurations.

In one embodiment, the below-the-ceiling junction 204 may include a second end 210. The second end 210 may, in some embodiments, be disposed opposite the first end 206. Stated another way, the second end 210 may be considered a bottom wall of the below-the-ceiling junction box 204 and the first end 206 may be considered a top wall of the below-the-ceiling junction box 204. In one embodiment, the second end 210 may be of a different material than a material of the first end 206. In a further embodiment, the second end 210 may be of a thermally conductive material and the first end 206 may be of a thermally insulating material so as to provide the thermal barrier between the above-the-ceiling area 1002 and the below-the-ceiling area 202. In an alternative embodiment, both the second end 210 and the first end 206 may be of the same material.

At least one junction box sidewall 212 may be interposed between the first end 206 and the second end 210. In a further embodiment, the junction box sidewall 212, the first end 206, and the second end 210 may together define a below-the-ceiling junction box cavity 300 within which electrical connections and devices may be disposed. It should be understood that there may be additional elements of the below-the-ceiling junction box 204 that also define the cavity 300 and/or enclose the electrical connections therein (e.g., additional sidewalls, doors, or sections). The junction box sidewall 212, the first end 206, and the second end 210 may enclose the electrical connections and devices within the cavity 300. As used herein, the term "enclose" is defined as entirely enclosed, as well as, substantially enclosed with one or more nominal openings, for example, for fasteners, wires, etc. In a preferred embodiment, the junction box sidewall 212 is a continuous sidewall. In other words, the junction box sidewall 212 may extend continuously about a periphery of the below-the-ceiling junction box 204. In a further embodiment, the junction box sidewall 212 may include nominal openings, such as, for example, to receive fasteners or locking members. As with the second end 210, the junction box sidewall 212 may also be of a material different than a material of the first end 206. In another embodiment, the junction box sidewall 212 may be of the same material as the material of the first end 206. In a further embodiment, the junction box sidewall 212 may be fixedly connected to the first end 206. In other embodiments, the junction box sidewall 212, and the first and second ends 206 and 210 may be of the same material.

The electrical connection and devices disposed within the cavity 300 may include a light socket 302, a terminal 304, and at least one electrical conductor 306 that may electrically couple the light socket 302 to the terminal 304. As used herein, the term "terminal" is intended to indicate an electrical terminal. The terminal 304 may provide a point of connection for the electrical conductors 306 within the cavity 300. In one embodiment, the terminal 304 may be formed as a terminal block 304, as shown in the exemplary embodiment depicted in FIG. 3. The terminal block 304 may also be considered a terminal board or strip that conveniently allows individual conductors 306 to connect without a splice or without physically directly joining the ends. In one embodiment, the terminal block 304 may include a plurality of quick connect terminals providing for quick, convenient connection of conductors 306 thereto. As used herein, the term "conductor" and "electrical conductor" are used interchangeably and both are intended to mean an electrical conductor, such as, for example, a wire or a cable. In other embodiments, the terminal 304 can be one or more wire nuts used to safely connect two wires to each other.

In one embodiment, the terminal 304 may include at least six quick connect terminals, with two terminals reserved for the light socket 302, two terminals reserved for conductors from the above-the-ceiling area 1002, and the two terminals reserved for yet another set of conductors from the above-the-ceiling area 1002 for daisy chaining multiple lights to a single switch. The term "above-the-ceiling area" is intended to indicate an area disposed directly above a ceiling, which, for residential homes, is typically an attic area. As used herein, the term "above-the-ceiling area," "attic area," and "attic air" may be used interchangeably and each are intended to mean an above-the-ceiling area. It should be understood that the terminal 304 may be provided in other shapes, sizes, and configurations and with more or less than six individual terminals in other embodiments of the present invention.

The light socket 302 may be provided as any number of a multitude of light sockets that are currently available and that may be available in the future. In a preferred embodiment, the light socket 302 is operable to couple to an LED light. In other embodiments, the light socket 302 may be operable to couple to other types of lights. The light socket 302 may be, for example, a GU10, E27, B22, S15, and the like. The light socket 302 may be configured to receive, for example, an Edison screw base, a bayonet mount light, a bi-pin connector, a wedge base connector, or any other type of light socket. The light socket 302 may be disposed and oriented to receive a ceiling light.

In one embodiment, the light socket 302 and the terminal 304 are at least partially disposed within the below-the-ceiling junction box 204. In a preferred embodiment, the light socket 302 and the terminal 304 are entirely disposed within the below-the-ceiling junction box 204 so as to provide a space-efficient, energy-efficient, and electrically compact design. As used herein, the term "entirely disposed" is intended to indicate that the light socket 302 and the terminal 304 are entirely disposed within the cavity 300 defined by the below-the-ceiling junction box 204, as well as, that the light socket 302 and the terminal 304 are substantially disposed within the cavity 300 defined by the below-the-ceiling junction box 204 having nominal portions thereof extending outside of the cavity 300. As an example, in one embodiment, a nominal bottom portion of the light socket 302 may extend slightly below the second end 210 for more ready accessibility to receive and couple to a light source 214. Any wiring should preferably not extend outside of the junction box cavity 300, except wiring coming from the above-the-ceiling area 1002 into the junction box cavity 300. Conventional ceiling mount light assemblies provide a light socket below the ceiling and a junction box separate from the light socket and disposed above the ceiling. In contrast, the below-the-ceiling junction box 204 of embodiments of the present invention provide each of the light socket 302, the terminal 304, and the junction box within a unitary junction box structure isolated from the attic area 1002.

In one embodiment, the ceiling mounted lighting assembly 200 may include a trim 216. The trim 216 may be considered an externally visible portion of the light assembly 200 and is preferably decorative and aesthetically pleasing. In one embodiment, the trim 216 is disposed to conceal the below-the-ceiling junction box 204 from an upward-looking view of a viewer during an installed configuration 1600 of the ceiling mounted lighting assembly 200. As used herein, the term "installed configuration" is intended to indicate a configuration, arrangement, and orientation of elements of the ceiling mounted lighting assembly 200 as it is installed on the ceiling 1000. Preferably, the trim 216 is disposed to conceal an entire periphery of the below-the-ceiling junction box 204 from a viewer disposed on a floor surface of the room within which the ceiling mounted lighting assembly 200 may be installed. In one embodiment, the trim 216 may be disposed beneath the below-the-ceiling junction box 204 and extend generally horizontally (in other words, generally parallel with a ground surface). In another embodiment, the trim 216 may be disposed beneath the below-the-ceiling junction box 204 and may extend outwardly beyond a plane defined by the junction box sidewall 212 so as to conceal the below-the-ceiling junction box 204. In yet another embodiment, the trim 216 may extend outwardly and upwardly towards the ceiling 1000 (in an installed configuration) in an arc configuration, as in the exemplary embodiment depicted in FIG. 2, so as to conceal the below-the-ceiling junction box 204 from vertical, as well as, side views.

In one embodiment, an absolute upper end 218 of the trim 216 may terminate at the same or substantially the same height as the first end 206 of the below-the-ceiling junction box 204 for additional concealment purposes. In other embodiments, the absolute upper end 218 may terminate above or below the first end 206. In another embodiment, the trim 216 may extend continuously about the below-the-ceiling junction box 204. In a further embodiment, the trim 216 may extend continuously about a periphery 220 of the junction box sidewall 212. In one embodiment, the trim 216 may be formed as a generally flat or curved panel and may be disposed a separation clearance distance 222 from the junction box sidewall 212. The separation clearance distance 222 may extend continuously about the periphery 220 of the below-the-ceiling junction box 204. In one embodiment, the trim 216 may be considered a junction box trim 216 and may be coupled to the below-the-ceiling junction box 204 so as to extend from the bottom end 210. In other embodiments, the trim 212 may be provided in other shapes, sizes, and configurations but should at least substantially conceal the below-the-ceiling junction box 204 from an upward-looking view of a viewer.

In one embodiment, the trim 216 may be fixedly connected to at least a portion of the below-the-ceiling junction box 204. In an alternative embodiment, the trim 216 may be removeably couplable to the below-the-ceiling junction box 204 so as to permit users to selectively interchange or change-out various types of decorative trims to use with the ceiling mounted lighting assembly 200.

In an alternative embodiment, the below-the-ceiling junction box 204 may not include a trim. In such an embodiment, the junction box sidewall 212 may itself include a decorative surface so as to provide a visually pleasing exterior surface. In a further embodiment, the first end 206 and/or the second end 210 of the below-the-ceiling junction box 204 may be of a different material than a material of the junction box sidewall 212, or provide a different visual appearance from that of the junction box sidewall 212. This is because the first end 206 and the second end 210 may, in such embodiments, be intended as concealed portions of the ceiling mounted lighting assembly 200 during its installed configuration.

In contrast to embodiments of the present invention, conventional junction boxes do not include decorative sidewalls or trims because conventional junction boxes are typically hidden from external view, recessed within or behind the ceiling 1000 or behind a wall. Advantageously, embodiments of the present invention provide the ceiling mounted lighting assembly 200 with a self-contained, i.e., the below-the-ceiling junction box 204, that prolongs the life of an LED ceiling light while also providing the decorative trim 216 coupled to the junction box 204 concealing the below-the-ceiling junction box 204 from external view.

In one embodiment, the ceiling mounted lighting assembly 200 may include a pair of ceiling fasteners 400. As used herein, the term "ceiling fastener" is defined as a mechanical device that mechanically joins, connects, affixes, or otherwise couples the ceiling mounted lighting assembly 200 to the ceiling 1000. In another embodiment, the ceiling mounted lighting assembly 200 may include less than two ceiling fasteners 400 or more than two ceiling fasteners 400. The ceiling fastener 400 may be coupled or couplable to the ceiling-mounting surface 208 of the first end 206. In another embodiment, the ceiling fastener 400 may be disposed to extend in a direction 402 away from the ceiling-mounting surface 208 so as to be couplable with the ceiling 1000. In one embodiment, the direction 402 may be considered a longitudinal direction of the ceiling fastener 400.

In one embodiment, the ceiling fastener 400 is formed so as to minimize any required openings in the ceiling 1000. Providing apparatuses and processes that minimize openings in the ceiling 1000 that result from the ceiling light installation process may reduce the thermal coupling between the above-the-ceiling area 1002 and the below-the-ceiling area 202, as compared to conventional ceiling light apparatuses and installation processes, which typically include relatively sizeable openings in the ceiling 1000. In one embodiment, the ceiling fastener 400 may include a ceiling-penetrating end 404 and a junction-box-coupling end 406. In another embodiment, the ceiling-penetrating end 404 may be opposite the junction-box-coupling end 406. The ceiling-penetrating end 404 may be disposed to penetrate the ceiling 1000 from the below-the-ceiling area 202 so as to secure the ceiling mounted lighting assembly 200 to the ceiling 1000 in the installed configuration. In one embodiment, the ceiling-penetrating end 404 may be formed as a pointed or tapered end operable to pierce a standard ceiling panel 1000 (e.g., drywall). In a further embodiment, the ceiling fastener 400 may include a threaded portion 408 disposed between the ends 404 and 406 to facilitate movement of the ceiling fastener 400 through a thickness of the ceiling panel 1000. In particular, the threaded portion 408 may allow a user to forcibly screw/twist the ceiling fastener 400 into the ceiling 1000. Preferably, the ceiling fastener(s) 400 coupled to the below-the-ceiling junction box 204 is/are operable, during normal residential or commercial building conditions, to support the ceiling mounted lighting assembly 200 on a standard ceiling 1000 (e.g., drywall), which may together include the below-the-ceiling junction box 204, the trim 216, and the light source 214.

Figure 5:
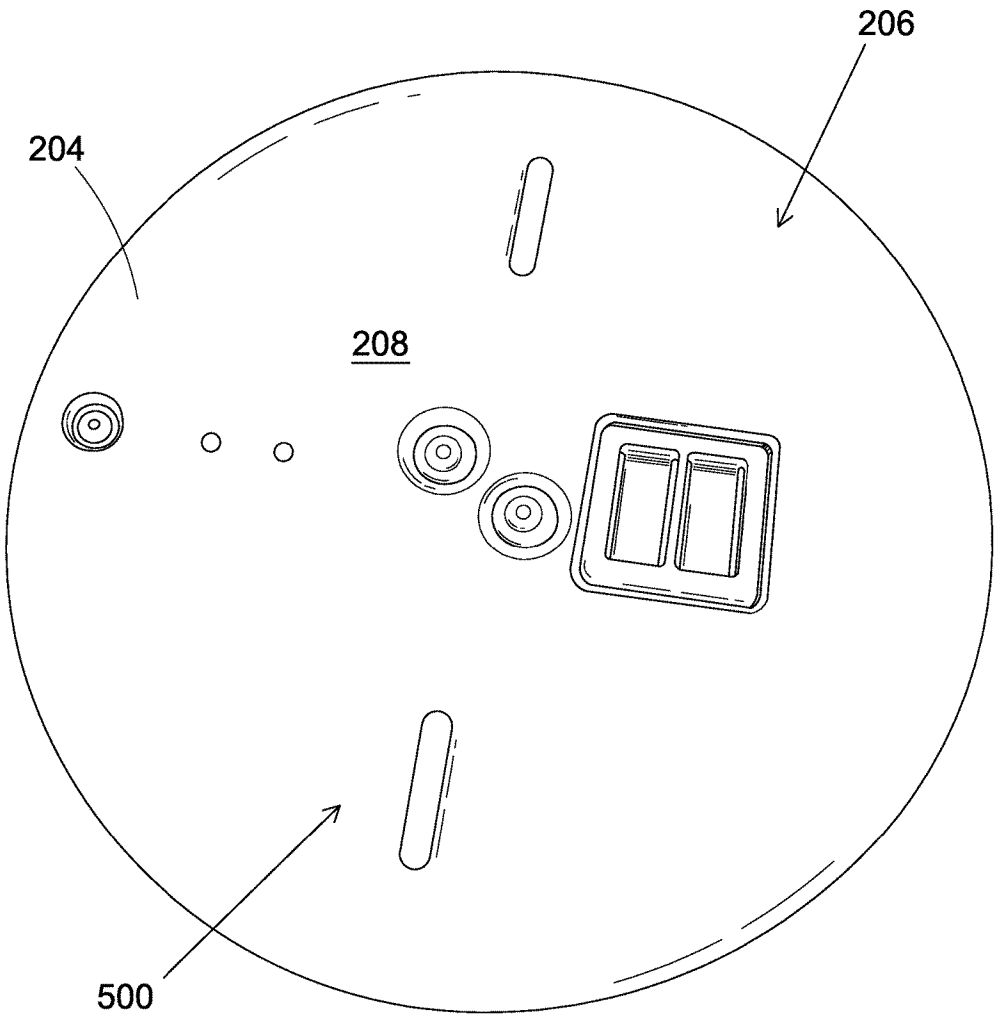
FIG. 5 is a fragmentary, top plan view of the top portion of the below-the-ceiling junction box of the ceiling mounted lighting assembly of FIG. 2, illustrating the exterior of the top portion shown without the pair of ceiling fasteners introduced in FIG. 4, in accordance with an embodiment of the present invention.

FIGS. 5 through 8 depict various features of the exemplary embodiment ceiling mounted lighting assembly 200 in various views. In particular, FIG. 5 shows the ceiling-mounting surface 208 of the first end 206 of the below-the-ceiling junction box 204 defining a plurality apertures 500, in a fragmentary, top plan view. At least one of the plurality of apertures 500 may be operable to receive the junction-box-coupling end 406 of the ceiling fastener 400. Another of the plurality of apertures 500 may be provided to receive at least one electrical conductor 306 from the attic area 1002 therethrough. Yet other ones of the plurality of apertures 500 may receive other fasteners therethrough for fastening the light socket 302, the terminal 304, and other components to the below-the-ceiling junction box 204.

Figure 6:
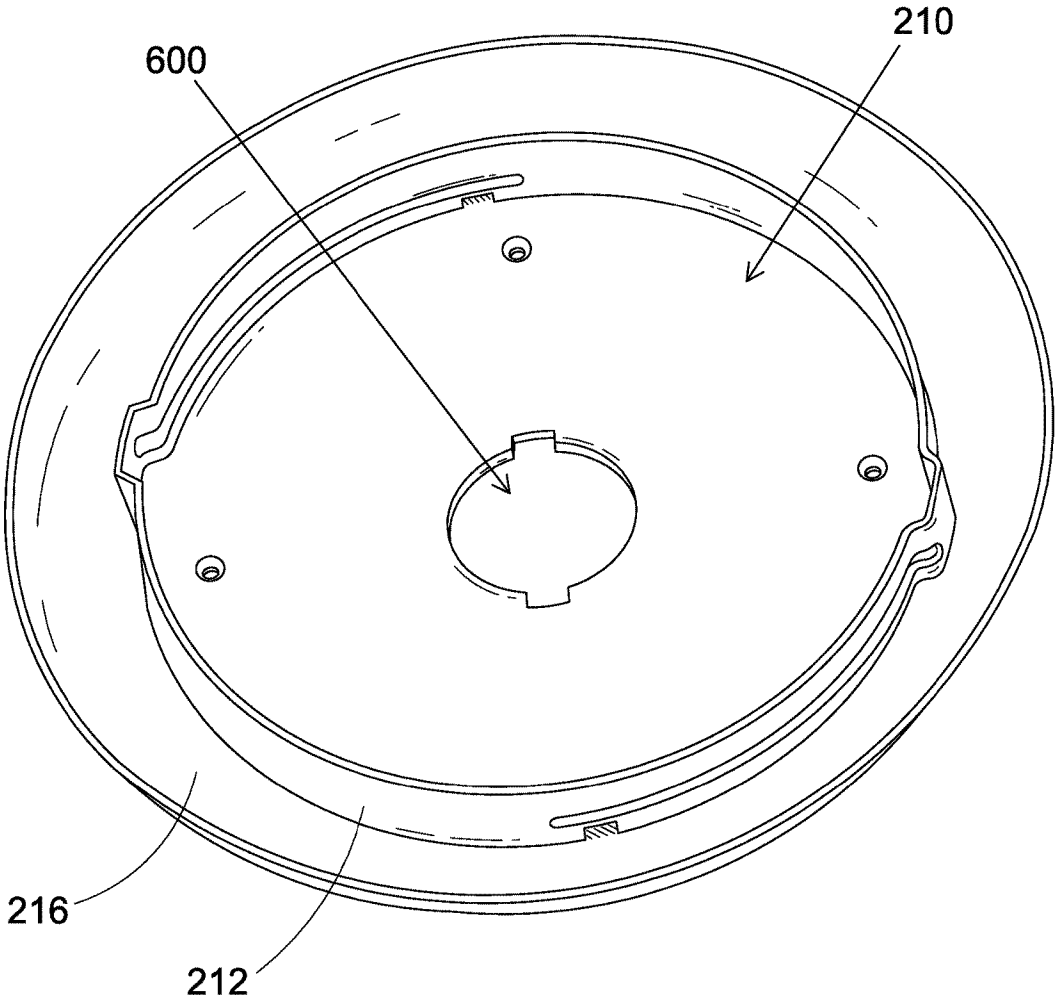
FIG. 6 is a fragmentary, downward-looking view of a bottom portion of the below-the-ceiling junction box of the ceiling mounted lighting assembly of FIG. 2, in accordance with an exemplary embodiment of the present invention.

FIG. 6 illustrates the second end 210 of the below-the-ceiling junction box 204 with the trim 216 extending therefrom, in a fragmentary, downward-looking perspective view. The bottom end 210 defines an aperture 600. The aperture 600 may be configured to receive the light source 214 therethrough for connecting to the light socket 302 disposed within the below-the-ceiling junction box 204. More specifically, the aperture 600 may be sized and shaped to receive a base (or male member) of the light source 214 to couple with the light socket 302. The body of the light source 214 that emits light rays may be disposed beneath the second end 210 so as to freely emit light rays towards the room below.

Figure 7:
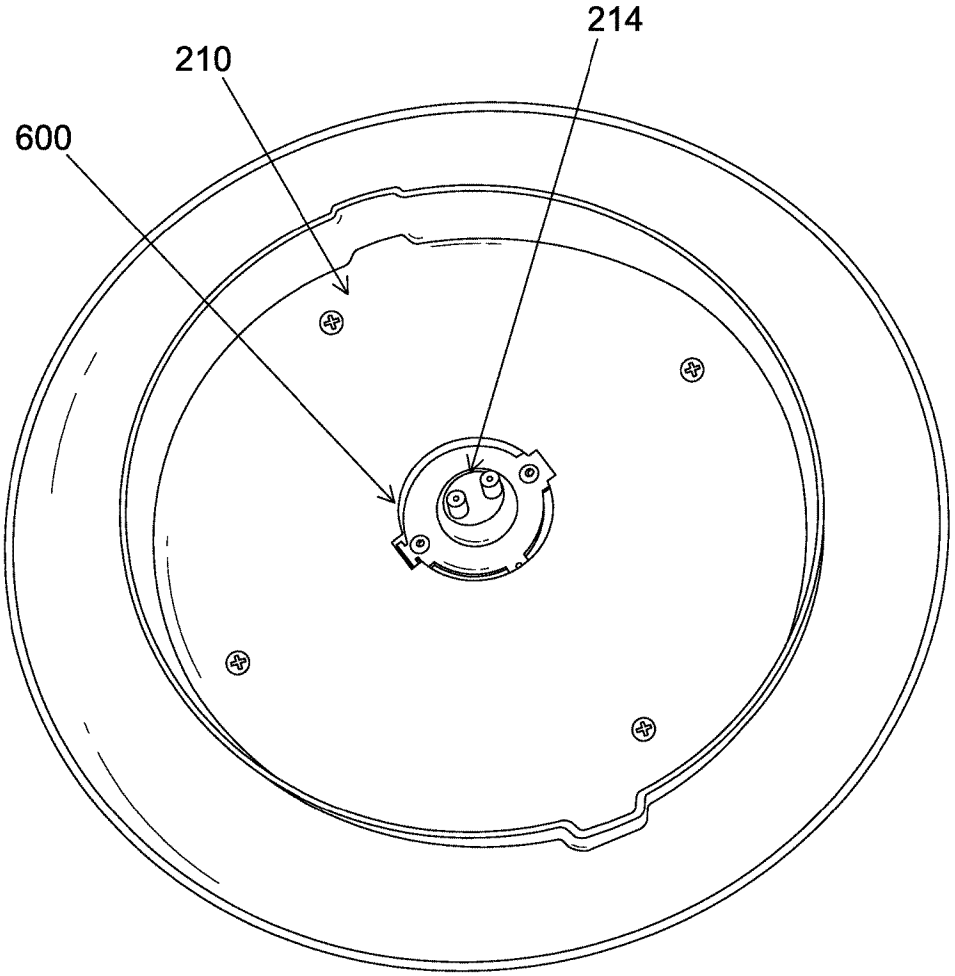
FIG. 7 is a fragmentary, downward-looking view of the bottom portion of the below-the-ceiling junction box of the ceiling mounted lighting assembly of FIG. 2, shown with a light source coupled to the bottom portion, in accordance with an exemplary embodiment of the present invention.
Figure 8:
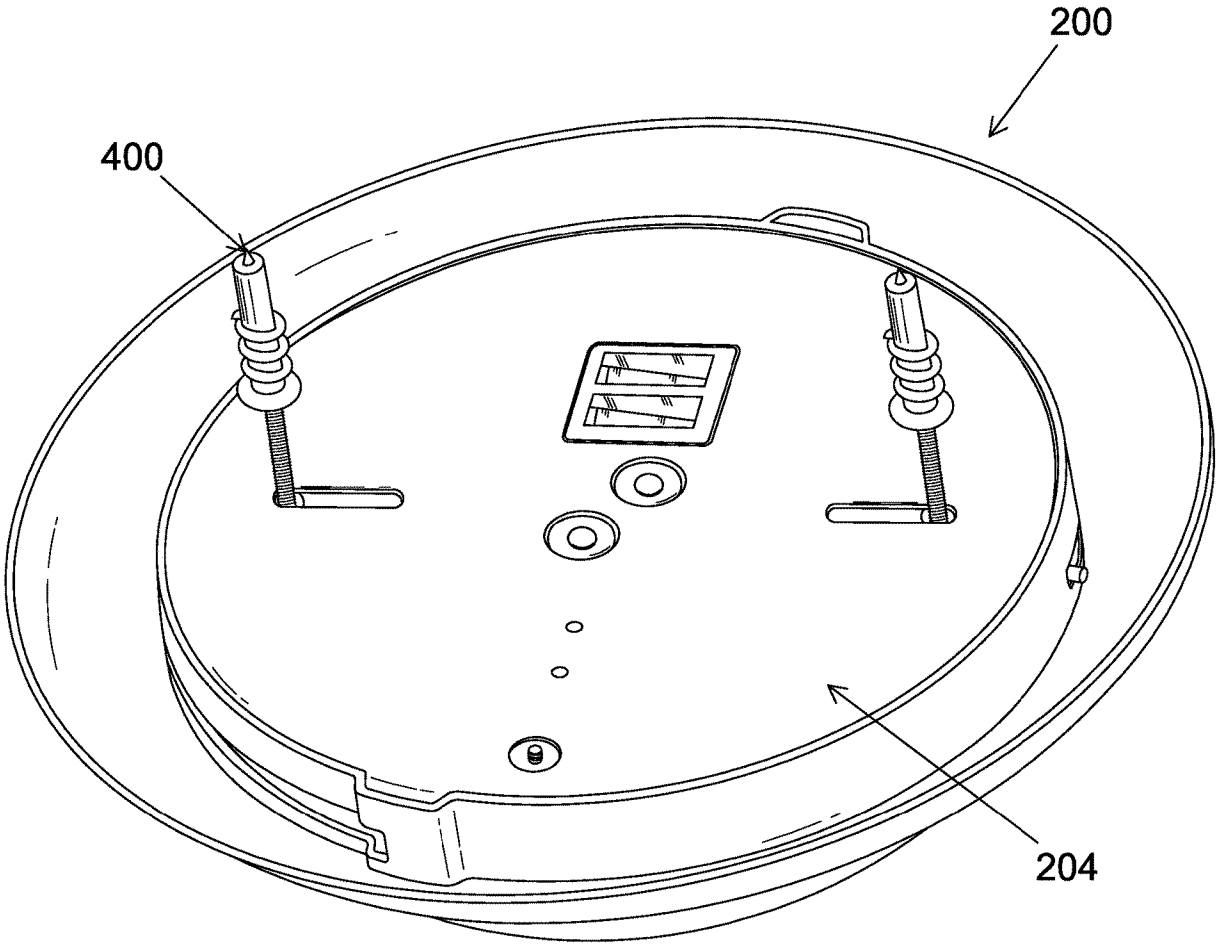
FIG. 8 is a downward-looking perspective view of the ceiling mounted lighting assembly of FIG. 2 with the pair of ceiling fasteners coupled thereto, in accordance with an embodiment of the present invention.
Figure 9:
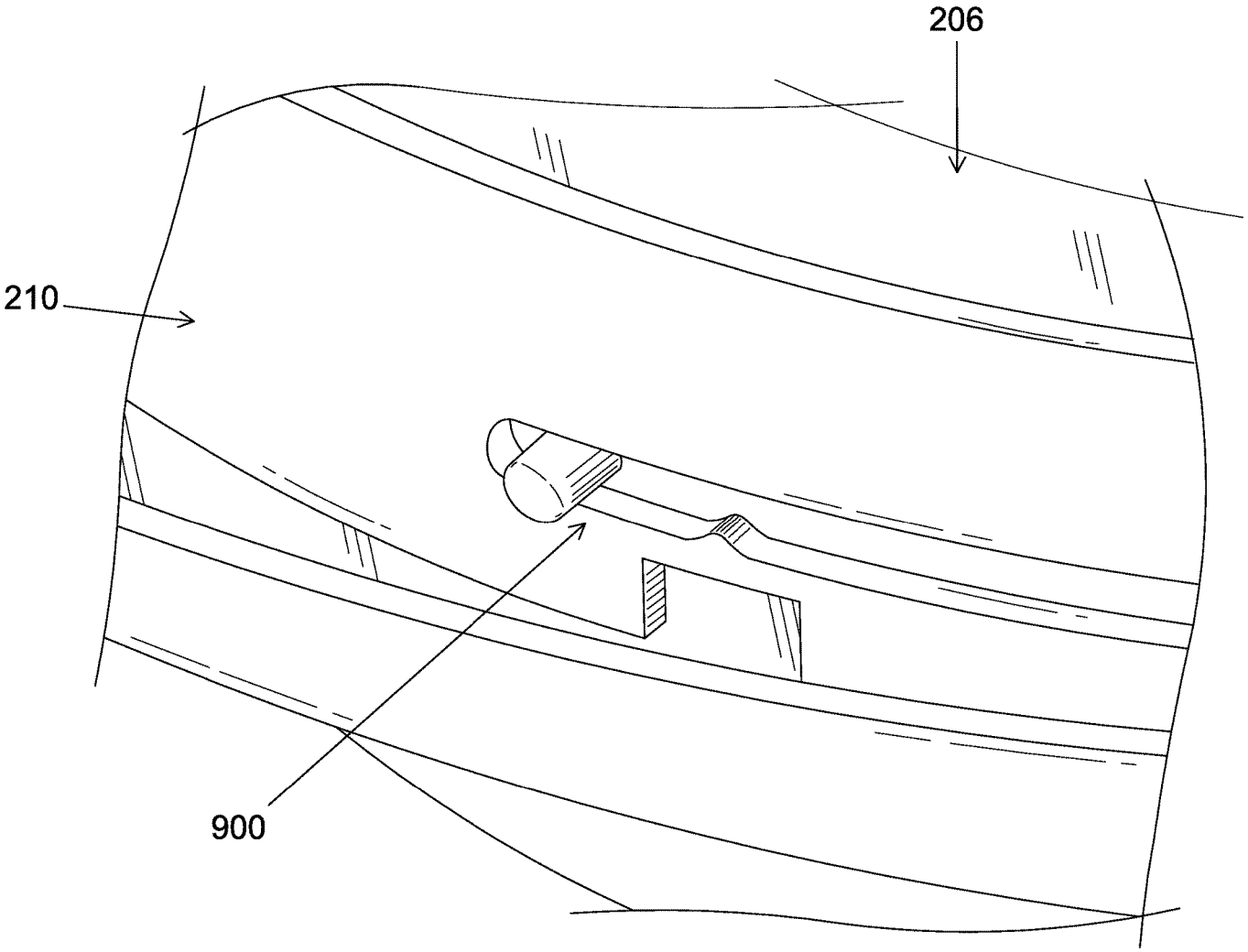
FIG. 9 is an enlarged, fragmentary view of a twist-lock feature of the below-the-ceiling junction box of FIG. 2, shown with the top portion coupled to the bottom portion, in accordance with an exemplary embodiment of the present invention.
Figure 10:
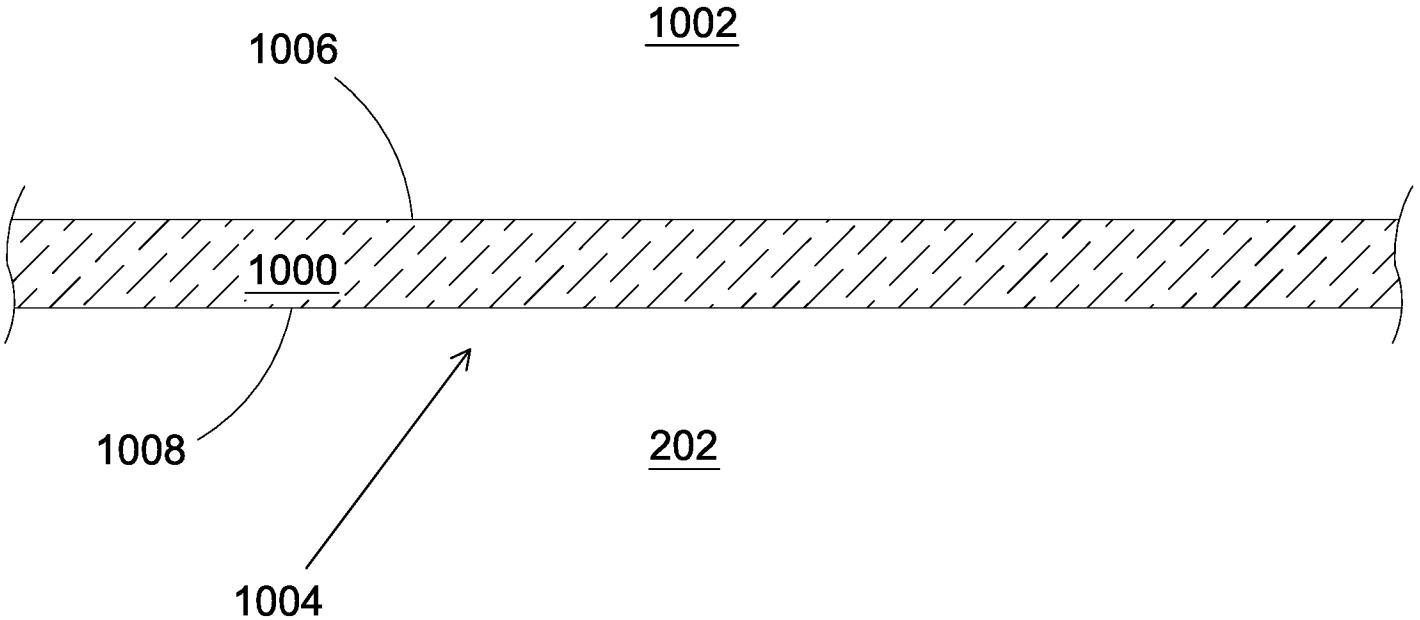
FIG. 10 is an elevational, cross-sectional side view of a mounting portion of a ceiling in accordance with an embodiment of the present invention.
Figure 11:
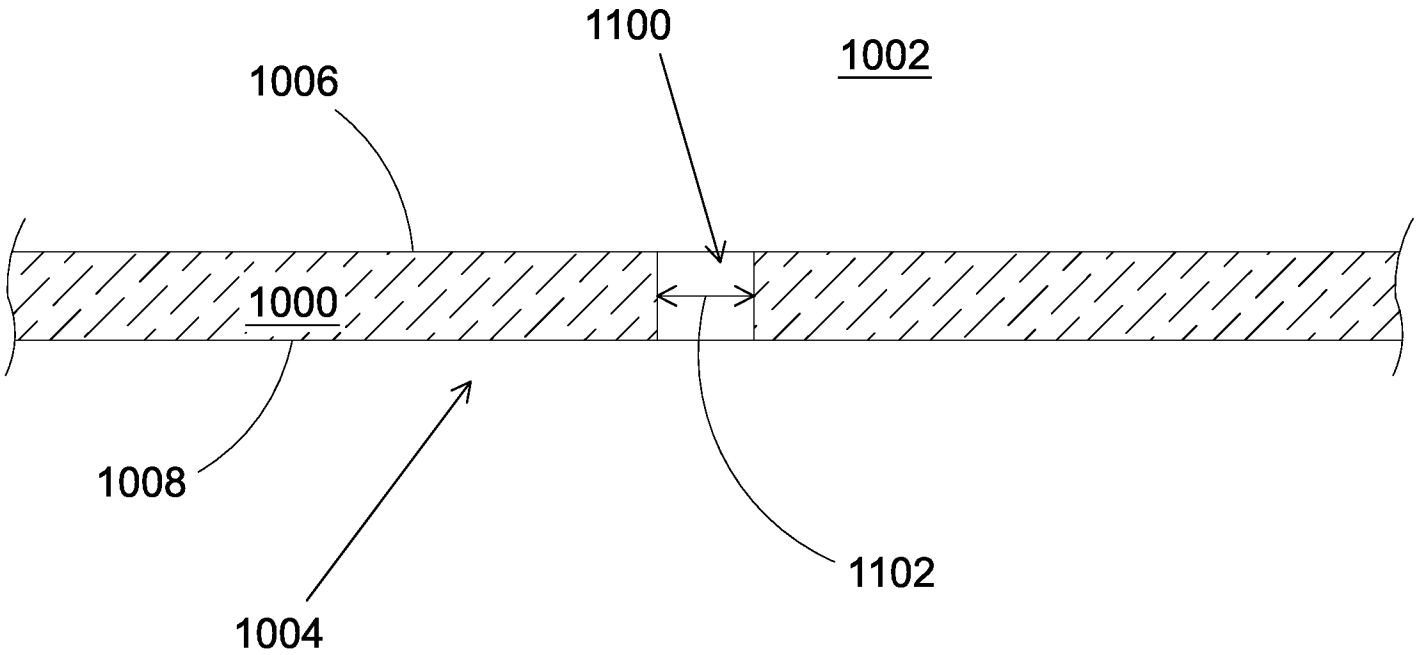
FIG. 11 is an elevational, cross-sectional side view of the mounting portion of the ceiling of FIG. 10, illustrating creation of an aperture within the mounting portion, in accordance with an embodiment of the present invention.

FIG. 7 illustrates the second end 210 of the below-the-ceiling junction box 204 in a fragmentary, downward-looking perspective view, as with FIG. 6. FIG. 7 further illustrates the base of the light source 214 inserted within the aperture 600. FIG. 8 illustrates the ceiling mounted lighting assembly 200 in an assembled configuration with the ceiling fasteners 400 coupled to the below-the-ceiling junction box 204. FIG. 9 illustrates a twist-lock feature 900 that is operably configured to selectively secure the first end 206 of the below-the-ceiling junction box 204 to the second end 210 in some embodiments. In one embodiment, the twist-lock feature 900 may include a male member and a mating female member configured for locking engagement. Preferably, the first end 206 may be selectively removable from the second end 210 so as to allow the user selective open access to the cavity 300 for electrically coupling conductors from the attic area 1002.

Referring now primarily to FIGS. 10 through 16, as well as, the flow chart in FIG. 1, the process for installing the ceiling mounted lighting assembly 200 may proceed with step 104, where a mounting portion 1004 of the ceiling 100 is located by the user/installer. The term "user" will be used herein below to describe the individual installing the ceiling mounted lighting assembly 200; however, it should be understood that the user may be an electrician, or may be the home owner or other building resident that is intended to utilize the light. As used herein, the term "mounting portion" is intended to indicate a portion of the ceiling 1000 on which the ceiling mounted lighting assembly 200 is intended to be positioned on, affixed to, or otherwise coupled to. In one embodiment, the mounting portion 1004 of the ceiling 1000 is considered an unimproved portion of the ceiling 1000. In other words, the mounting portion 1004 of the ceiling 1000 may be devoid of any pre-existing ceiling apertures or pre-existing ceiling fixtures. Stated yet another way, the mounting portion 1004 is preferably a continuous portion of the ceiling panel 1000, i.e., without any pre-existing apertures so as to minimize thermal coupling between the above-the-ceiling area 1002 and the below-the-ceiling area 202. In one embodiment, the mounting portion 1004 of the ceiling 1000 includes a first surface 1006 and a second surface 1008. The first surface 1006 may be opposite the second surface 1008. The first surface 1006 may be considered an above-the-ceiling-facing surface 1006 and the second surface 1008 may be considered a below-the-ceiling-facing surface 1008.

In step 106, an aperture 1100 may be created, by the user, within the mounting portion 1004 as a through-hole extending through the first surface 1006 and the second surface 1008. The aperture 1100 is preferably of a relatively small diameter 1102, as compared to convention ceiling holes for conventional ceiling mounted light assemblies. In a preferred embodiment, the aperture 1100 is sized and shaped to insert at least one electrical conductor 1200 therethrough from the above-the-ceiling area 1002. In one embodiment, the aperture 1100 is sized to be no greater than 2 inches at its greatest width. In another embodiment, the aperture 1100 is sized to be no greater than 1 inch at its greatest width. In other embodiments, the aperture 1100 may be outside of these ranges. The aperture 1100 may be created by any known method or device, such as, for example, a drill.

Figure 12:
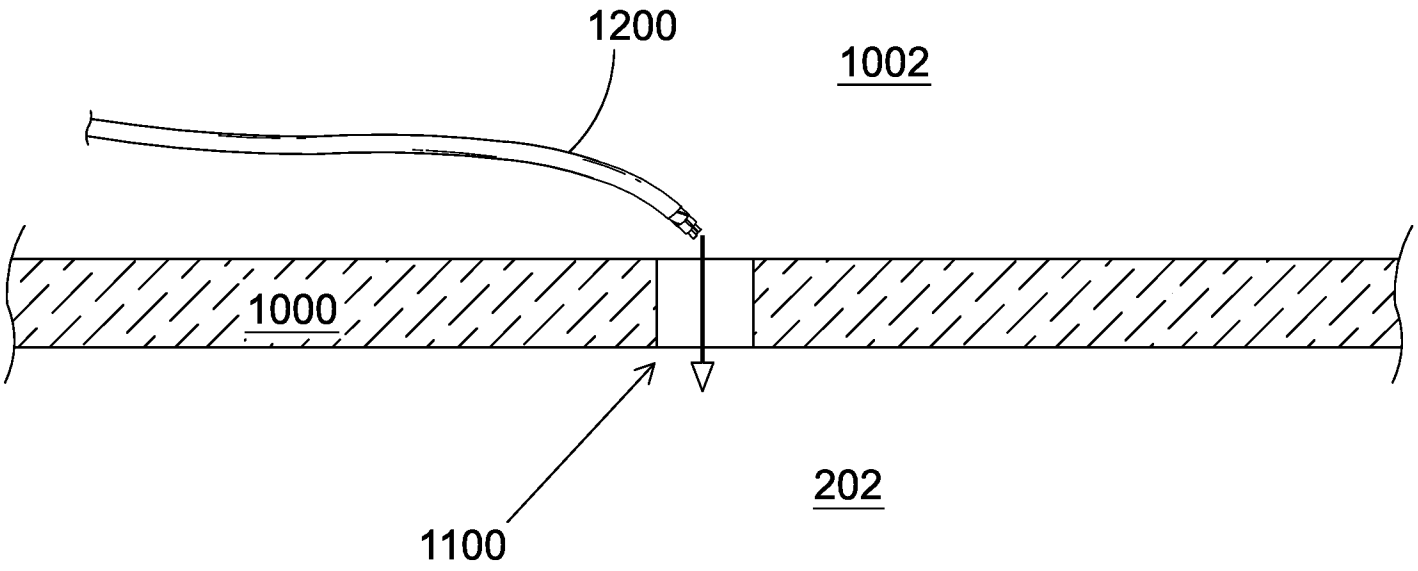
FIG. 12 is an elevational, cross-sectional side view of the mounting portion of the ceiling of FIG. 11, illustrating insertion of an electrical conductor through the aperture, in accordance with an embodiment of the present invention.
Figure 13:
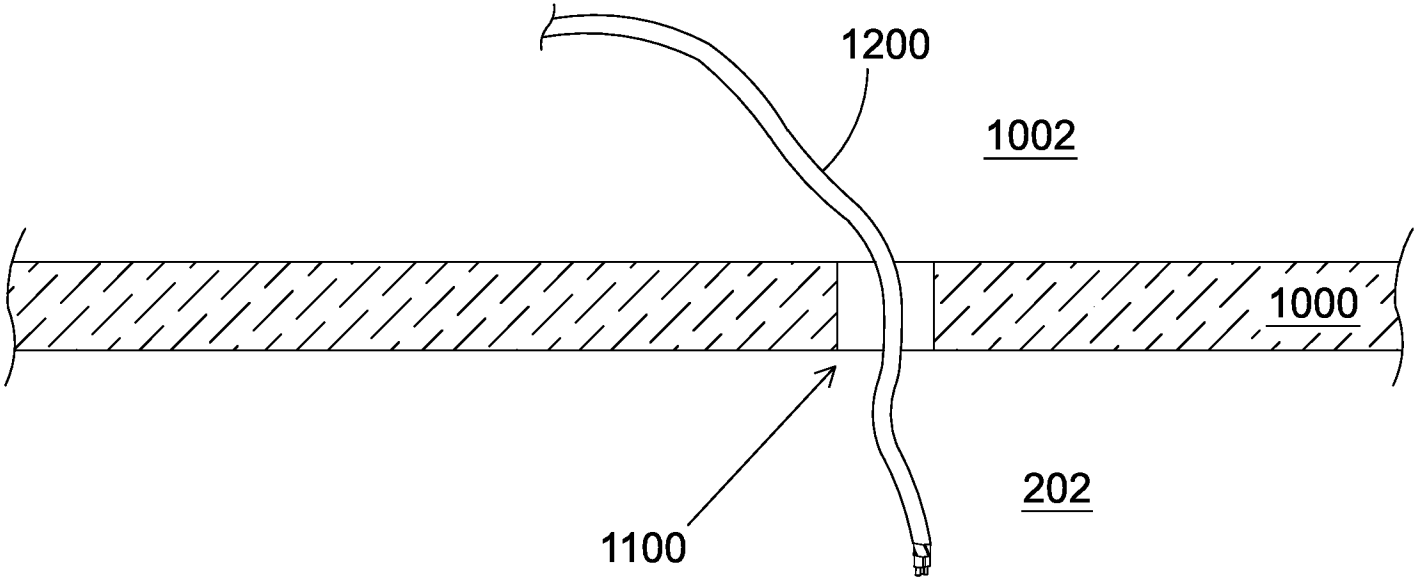
FIG. 13 is an elevational, cross-sectional side view of the mounting portion of the ceiling of FIG. 12, illustrating insertion of the electrical conductor into a below-the-ceiling area without passing the electrical conductor through a conventional above-the-ceiling junction box, in accordance with an embodiment of the present invention.

In step 108, the electrical conductor 1200 may be inserted from the above-the-ceiling area 1002 through the aperture 1100 to the below-the-ceiling area 202, as illustrated in FIGS. 12-13. Although the term "the electrical conductor" is used herein, it should be understood that the user may also insert more than one electrical conductor through the aperture 1100. In one embodiment, the electrical conductor 1200 may be inserted directly through the aperture 1100 from the above-the-ceiling area 1002 to the below-the-ceiling area 202 without passing the electrical conductor 1200 through an above-the-ceiling junction box. Above-the-ceiling junction boxes are typically disposed on top of the ceiling 1000 above the ceiling mounted light. As discussed herein above, by eliminating the use of the conventional above-the-ceiling junction box, embodiments of the present invention may prolong the life of the light source 214 by reducing thermal coupling of the light source 214 and associated electronic components with the attic air 1002, which is susceptible to temperature extremes that degrade LED lights.

Figure 14:
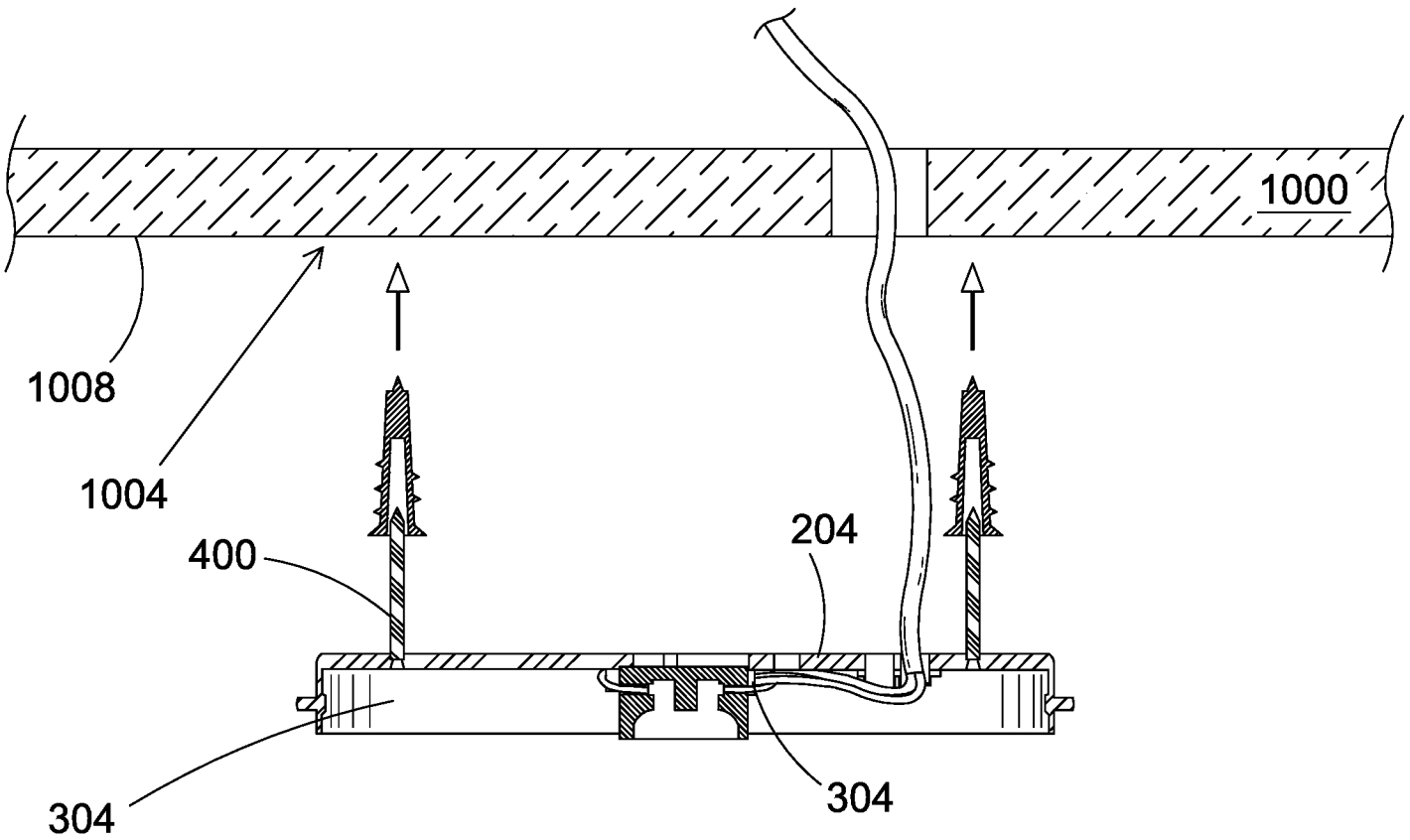
FIG. 14 is an elevational, cross-sectional side view of the mounting portion of the ceiling of FIG. 13, illustrating coupling of the electrical conductor with an electrical terminal disposed within the below-the-ceiling junction box of FIG. 2, in accordance with an embodiment of the present invention.
Figure 15:
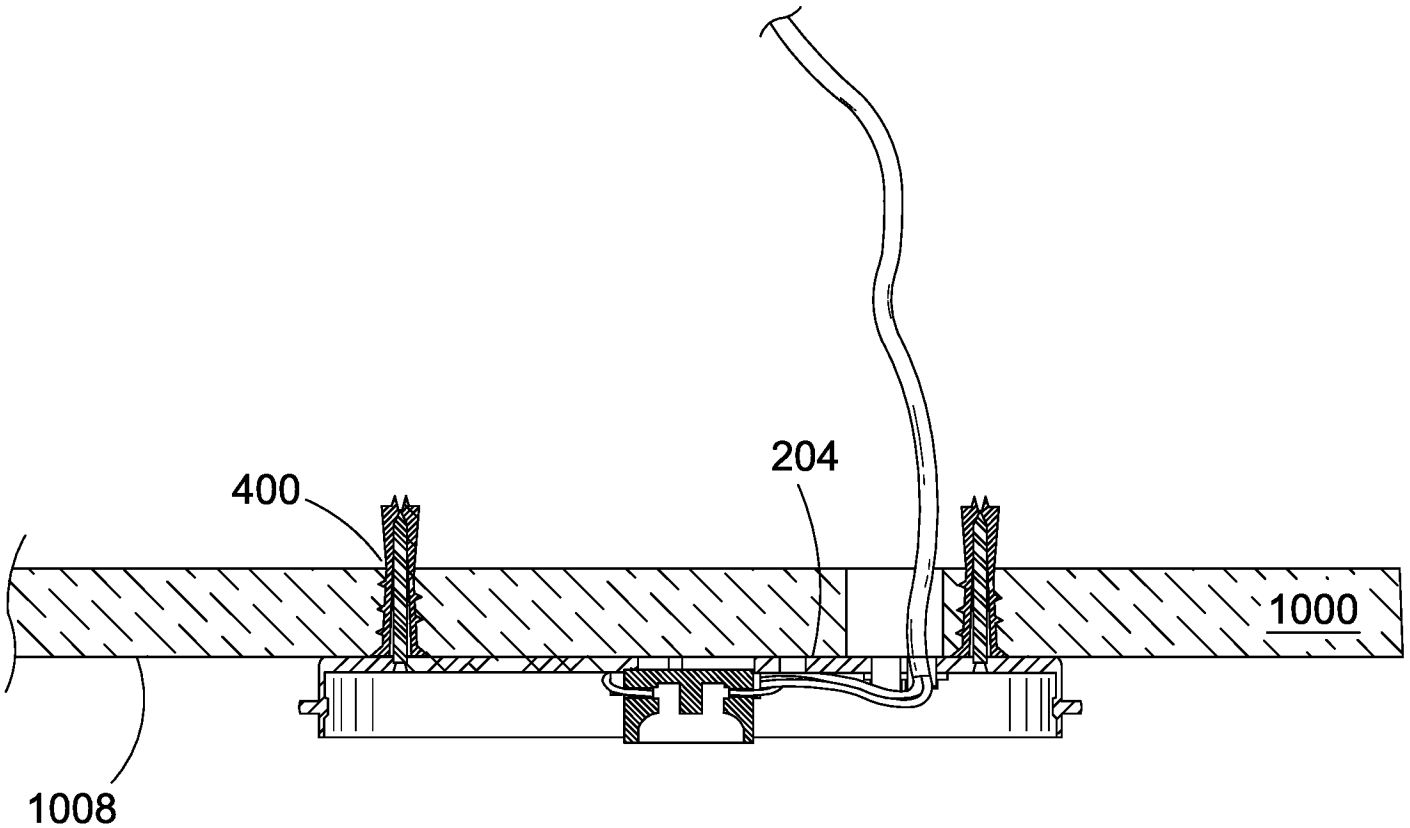
FIG. 15 is an elevational, cross-sectional side view of the mounting portion of the ceiling of FIG. 14, illustrating coupling the below-the-ceiling junction box of FIG. 2 to the ceiling using the pair of ceiling fasteners introduced in FIG. 4, in accordance with an embodiment of the present invention.
Figure 16:
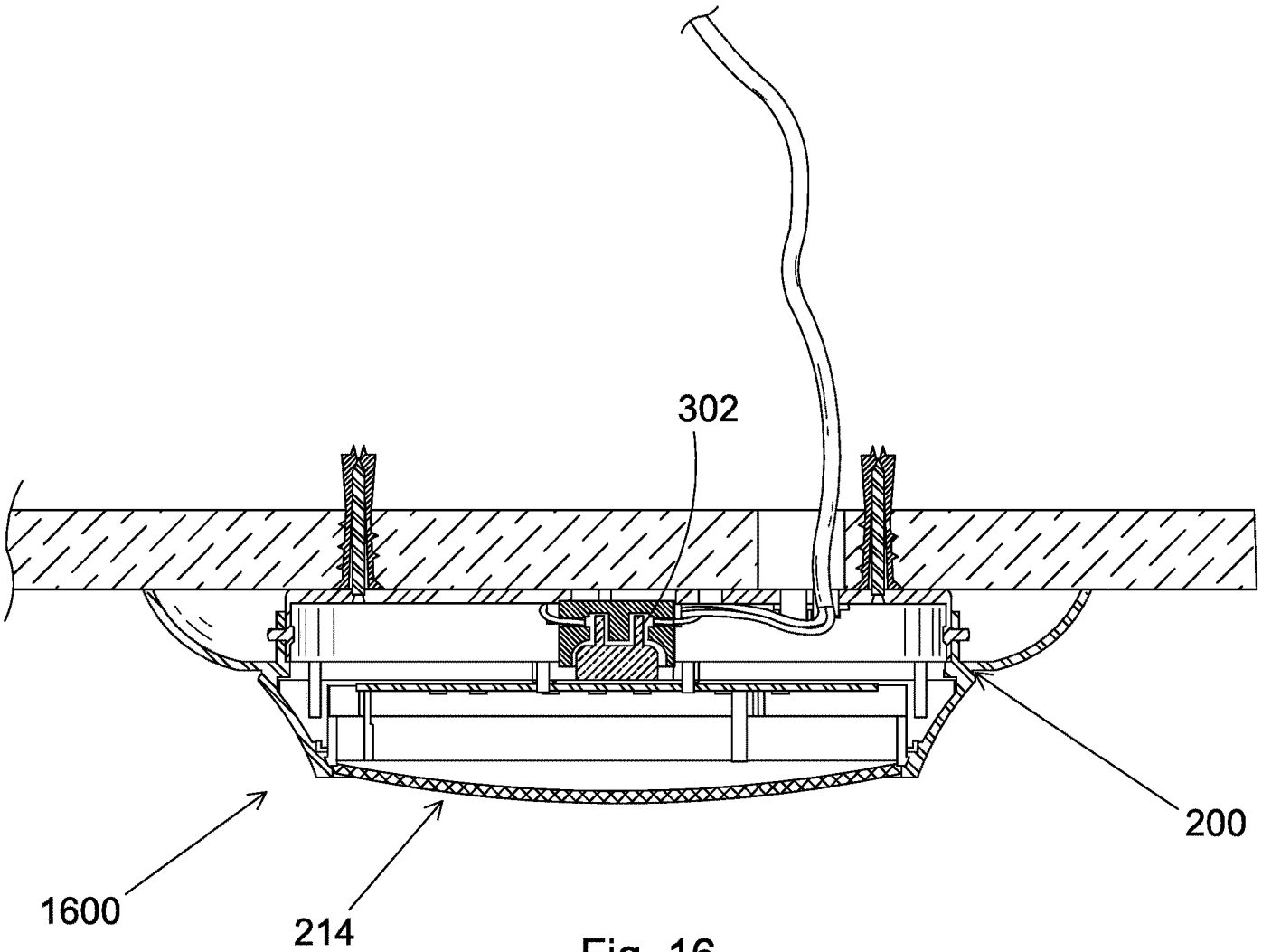
FIG. 16 is an elevational, cross-sectional side view of the mounting portion of the ceiling of FIG. 15, illustrating coupling the light source to a light socket disposed within the below-the-ceiling junction box of FIG. 2, in accordance with an embodiment of the present invention.

In step 110, the user may couple the electrical conductor 1200 to the terminal 304 that is disposed within the below-the-ceiling junction box 204, as illustrated in FIG. 14. The user may couple the electrical conductor 1200 to the terminal 304 by any known method of electrically coupling conductors 1200 to an electrical terminal 304. In step 112, the user may insert the ceiling fastener 400 through the mounting portion 1004 of the ceiling 1000 so as to secure the below-the-ceiling junction box 204 against the second surface 1008 of the ceiling 1000, as illustrated in FIGS. 14-15. In one embodiment, the below-the-ceiling junction box 204 may be flush against the ceiling 1000. In another embodiment, the below-the-ceiling junction box 204 may be disposed a nominal distance from the ceiling 1000. In step 114, the user may couple the light source 214 to the light socket 302. In some embodiments, the user may couple the light source 214 to the light socket 302 prior to mounting the below-the-ceiling junction box 204 to the ceiling 1000 in step 112. The user may couple the light source 214 to the light socket 302 by, for example, twisting the base of the light source 214 into the light socket 302. Such twisting may be considered a one-step mechanical and electrical coupling. In other embodiments, the user may couple the light source 214 to the light socket 302 by any known method of coupling a light to its mating light socket. As can be seen, with reference to at least FIGS. 15 and 16, the light source 214 may also be considered a junction box cover 214, with a light-emitting downwardly-facing surface, for the below-the-ceiling junction box 204 that encloses the electrical connectors on all sides when the junction box cover 214 is coupled to the below-the-ceiling junction box 204. The process may immediately end at step 116.

A novel and efficient apparatus and method for installing a ceiling mounted lighting assembly with a self-contained junction box disposed within a below-the-ceiling area has been disclosed. Embodiments of the invention provide a below-the-ceiling junction box having a ceiling-mounting surface and a light socket disposed at least partially within the below-the-ceiling junction box. In addition, embodiments of the invention provide for the ceiling-mounting surface to be of a thermally non-conductive material and operable as a thermal barrier between the above-the-ceiling area and the below-the-ceiling area. Further embodiments of the invention include installing the ceiling mounted lighting assembly with the self-contained junction box to a finished ceiling without any pre-existing ceiling installations and without utilizing a conventional above-the-ceiling junction box so as to minimize any openings into the above-the-ceiling area. Other embodiments of the present invention include a decorative trim disposed about the below-the-ceiling junction box so as to conceal the below-the-ceiling junction box from an upward-looking view of a viewer during an installed configuration of the light assembly. Embodiments of the present invention mitigate the exposure of ceiling mounted LED lights to the superheated attic air and excessive temperature fluctuations associated with attic temperatures, thereby prolonging the life span of ceiling mounted LED lights. In addition, embodiments of the present invention provide for user-friendly and convenient installation of ceiling mounted lights that reduce the complexity of existing ceiling mounted light installation processes and apparatuses and that minimize thermally coupling of the LED lights to the attic area.

What is claimed is:

1. A method of installing a ceiling mounted lighting assembly, the method comprising steps of:

providing a ceiling mounted lighting assembly within a below-the-ceiling area, the ceiling mounted lighting assembly including:

a below-the-ceiling junction box having a first end with a ceiling-mounting surface and a light socket disposed at least partially within the below-the-ceiling junction box;

a terminal disposed at least partially within the below-the-ceiling junction box and electrically couplable to the light socket; and at least one ceiling fastener coupled to the ceiling-mounting surface and extending in a direction away from the ceiling-mounting surface;

locating a mounting portion of a ceiling on which to mount the ceiling mounted lighting assembly;

inserting at least one electrical conductor from an above-the-ceiling area directly through an aperture defined by the ceiling to the below-the-ceiling area without passing the at least one electrical conductor through an above-the-ceiling junction box that vertically overlaps the mounting portion of the ceiling, the aperture being sized smaller than the below-the-ceiling junction box;

coupling the at least one electrical conductor to the terminal disposed at least partially within the below-the-ceiling junction box; and inserting the at least one ceiling fastener through at least a portion of the mounting portion of the ceiling so as to secure the below-the-ceiling junction box against a below-the-ceiling-facing surface of the ceiling.

2. The method in accordance with claim 1, wherein the step of providing the ceiling mounted lighting assembly further includes a step of:

providing the first end of the below-the-ceiling junction box as a thermal barrier between the above-the-ceiling area and the below-the-ceiling area.

3. The method in accordance with claim 1, wherein the step of providing the ceiling mounted lighting assembly further includes a step of:

providing the ceiling-mounting surface of the first end with a thermally insulating material.

4. The method in accordance with claim 1, further comprising a step of:

coupling a light source to the light socket at least partially disposed within the below-the-ceiling junction box with a one-step mechanical and electrical coupling.

5. The method in accordance with claim 1, further comprising a step of:

drilling into at least a portion of the mounting portion of the ceiling so as to create the aperture as a through-hole extending through above-the-ceiling-facing surface and the below-the-ceiling-facing surface, the above-the-ceiling-facing surface opposite the below-the-ceiling-facing surface.

6. The method in accordance with claim 1, wherein the step of providing the ceiling mounted lighting assembly further includes a step of:

providing the ceiling mounted lighting assembly with the light socket and the terminal entirely disposed within the below-the-ceiling junction box.

7. The method in accordance with claim 1, wherein the step of providing the ceiling mounted lighting assembly further includes a step of:

providing the below-the-ceiling junction box with a trim at least one of fixedly connected to the below-the-ceiling junction box and removeably couplable to the below-the-ceiling junction box, the trim disposed to conceal the below-the-ceiling junction box from an upward-looking view of a viewer during an installed configuration of the ceiling mounted lighting assembly.

8. The method in accordance with claim 1, wherein the step of providing the ceiling mounted lighting assembly further includes a step of:

providing the below-the-ceiling junction box with:

a second end opposite the first end;

at least one junction box sidewall interposed between the first end and the second end, the first and second ends and the at least one junction box sidewall defining a below-the-ceiling junction box cavity within which the light socket and the terminal are at least partially disposed; and a trim disposed to conceal the below-the-ceiling junction box from an upward-looking view of a viewer during an installed configuration of the ceiling mounted lighting assembly.

9. The method in accordance with claim 8, wherein the step of providing the ceiling mounted lighting assembly further includes a step of:

providing the trim continuously about a periphery of the at least one junction box sidewall.

10. The method in accordance with claim 8, wherein the step of providing the ceiling mounted lighting assembly further includes a step of:

providing the trim coupled to the below-the-ceiling junction box so as to extend from the second end of the below-the-ceiling junction box outwardly and upwardly beyond a plane defined by the at least one junction box sidewall.

11. A ceiling mounted lighting assembly with a self-contained junction box comprising:

a below-the-ceiling junction box having a first end with a ceiling-mounting surface; and a junction box cover:

having a light-emitting downwardly-facing surface;

removeably couplable to the below-the-ceiling junction box; and having a periphery disposed to conceal the below-the-ceiling junction box from view when the junction box cover is coupled to the below-the-ceiling junction box and the ceiling-mounting surface is mounted to a ceiling.

12. The ceiling mounted lighting assembly in accordance with claim 11, wherein:

the junction box cover encloses at least one electrical connector on all sides when the junction box cover is coupled to the below-the-ceiling junction box.

13. The ceiling mounted lighting assembly in accordance with claim 12, wherein:

the at least one electrical connector is formed as at least one of an electrical terminal and a light socket operably configured to supply power to the light-emitting downwardly-facing surface of the junction box cover.

14. The ceiling mounted lighting assembly in accordance with claim 11, further comprising:

at least one ceiling fastener coupled to the ceiling-mounting surface and extending in a direction away from the ceiling-mounting surface.

15. The ceiling mounted lighting assembly in accordance with claim 14, wherein:

the at least one ceiling fastener includes a ceiling-penetrating end opposite a junction-box-coupling end of the at least one ceiling fastener, the ceiling-penetrating end disposed to penetrate a ceiling from a below-the-ceiling area so as to secure the ceiling mounted lighting assembly to the ceiling in an installed configuration.

16. The ceiling mounted lighting assembly in accordance with claim 11, wherein:

the junction box cover is removeably couplable to a second end of the below-the-ceiling junction box, the second end disposed opposite the first end.

17. The ceiling mounted lighting assembly in accordance with claim 11, further comprising:

a light socket disposed at least partially within the below-the-ceiling junction box, the light socket operably configured to provide a one-step mechanical and electrical coupling of the light socket to the junction box cover.

18. The ceiling mounted lighting assembly in accordance with claim 11, wherein the below-the-ceiling junction box further includes:

a second end opposite the first end; and at least one junction box sidewall interposed between the first end and the second end, the first and second ends and the at least one junction box sidewall defining a below-the-ceiling junction box cavity within which at least one electrical terminal is at least partially disposed; and wherein:

the at least one electrical terminal is operably configured to supply power to the light-emitting downwardly-facing surface of the junction box cover; and the junction box cover encloses the at least one electrical terminal within the below-the-ceiling junction box on all sides when the junction box cover is coupled to the below-the-ceiling junction box.

19. The ceiling mounted lighting assembly in accordance with claim 18, wherein:

the periphery of the junction box cover includes a trim disposed continuously about a periphery of the at least one junction box sidewall.

20. The ceiling mounted lighting assembly in accordance with claim 18, wherein:

the periphery of the junction box cover includes a trim coupled to the below-the-ceiling junction box so as to extend from the second end of the below-the-ceiling junction box outwardly and upwardly beyond a plane defined by the at least one junction box sidewall.

* * * * *